United States Patent [19]

Valley et al.

[11] 4,259,547

[45] Mar. 31, 1981

[54] HEARING AID WITH DUAL PICKUP

[75] Inventors: Robert A. Valley, Branford; David S. MacDonald, Cheshire, both of Conn.

[73] Assignee: Earmark, Inc., Hamden, Conn.

[21] Appl. No.: 11,728

[22] Filed: Feb. 12, 1979

Related U.S. Application Data

[63] Continuation-in-part of Ser. No. 900,203, Apr. 26, 1978, abandoned.

[51] Int. Cl.[3] ..... H04R 1/28; H04R 25/00

[52] U.S. Cl. ..... 179/1 B; 179/1 C; 179/1 P; 179/107 H; 179/180

[58] Field of Search ..... 179/107 H, 107 R, 107 S, 179/1 C, 1 B, 1 P, 107 FD, 2 C, 107 E, 182 R, 180, 179

[56] References Cited

U.S. PATENT DOCUMENTS

| | | | |
|---|---|---|---|
| 2,659,772 | 11/1953 | O'Hara | 179/107 R |
| 2,939,923 | 6/1960 | Henderson | 179/182 R |
| 3,126,977 | 3/1964 | McGee | 179/107 EX |
| 3,201,528 | 8/1965 | Johanson et al. | 179/107 H |
| 3,619,507 | 11/1971 | Metz | 179/1 C |
| 3,659,056 | 4/1972 | Morrison et al. | 179/1 B X |
| 3,749,853 | 7/1973 | Ely et al. | 179/107 H |
| 4,061,875 | 12/1977 | Freifeld et al. | 179/1 P |

OTHER PUBLICATIONS

"A Wearable Master Hearing Aid", by Torick et al., *J. Audio Eng. Soc.*, vol. 23, No. 5, Jun. 1975, pp. 361–368.

*Primary Examiner*—Thomas W. Brown

*Attorney, Agent, or Firm*—Griffin, Branigan & Butler

[57] ABSTRACT

A conventional hearing aid for a hard-of-hearing person has a microphone input for sensing sounds or voice communication. In a high noise environment, a somewhat remotely located speaker wishing to communicate with the person talks into a microphone input to a transmitter so that his spoken word is transmitted as a modulated carrier wave. The hard-of-hearing person is provided with a receiver which receives and detects the modulated carrier wave. The detected signal is applied to a transducer to reproduce the spoken word. A hollow elongated conduit comprising a flexible tube having a small bore extending therethrough, conducts the audible sound representing the spoken word from the transducer to the microphone input of the hearing aid, thus enabling the wearer of the hearing aid to hear the remotely spoken sounds of a lower level than the ambient noise while at the same time hearing the ambient noise. The conduit may contain a wire for acoustic loading and/or structural strength. The receiver is detachable from the transducer so that the transducer may be worn or carried about with the hearing aid by the user.

18 Claims, 6 Drawing Figures

HEARING AID WITH DUAL PICKUP

This application is a continuation-in-part of our copending application Ser. No. 900,203 filed Apr. 26, 1978 (now abandoned).

BACKGROUND OF THE INVENTION

This invention relates to hearing aids and more particularly to a method and means for enabling the user of a hearing aid to hear speech from a remote distance even though the level of the speech may be lower than the ambient noise level in the region of the user.

A conventional hearing aid of the prior art is worn in or about the user's ear or on the body and comprises a housing having therein a microphone for receiving audible sound and converting it to an electrical signal, and an amplifier for amplifying the electrical signal. A transducer, which may or may not be within the housing, converts the electrical signal back to audible sound which is then applied to the user's ear.

A problem arises when a hard-of-hearing person attempts to use a hearing aid in an environment having a high ambient noise level. The conventional hearing aid amplifies all sound picked up by the microphone to the same degree, hence ambient noise is amplified and may override a voice communication. Consider, for example, a typical speech training classroom wherein the ambient noise level may exceed 70 db. The voice level of a teacher, at a distance of six inches from the mouth, is typically 80 db. However, since sound power drops 6 db for each doubling of distance, within a very few feet a negative ambient noise to teacher voice levels exists. Meaningful communication is not possible since the noise is amplified by the same factor as the teacher's voice. Thus, it is necessary to establish a voice link between the teacher and student.

One of the currently used methods of establishing the teacher-student voice link involves FM transmission of the teacher's voice to the student's receiver. In addition to receiving the FM transmission from the teacher, the student's receiver is provided with one or two microphones for reception of his own voice (an important requirement for speech training) and the voices of other students in the class. Because of the radio link, the teacher's voice is always clearest because the level of the teacher's voice is set to dominate over any environmental noise.

A further disadvantage exists in the prior art system in that it requires a separate receiver/aid and the student's personal aid must be removed during class hours. Thus, the prior art system requires a duplication of equipment and further requires that the student's personal hearing aid, that has been carefully adjusted by an audiologist, must be removed and replaced by a completely different unit that may not have the same characteristics as the personal aid.

Some attempts have been made to avoid this duplication and enable the student's personal hearing aid to be used in the classroom. These attempts have employed a magnetic (telephone pickup) coil in the aid to couple in the voice from a radio link. This arrangement suffers from several disadvantages. Switching to the "tele" position disconnects the internal microphone and prevents the student from hearing his own voice. The "tele" coils vary widely in performance and do not give the consistency of frequency response required for proper speech development. External magnetic fields may seriously interfere with proper reception. Finally, many personal hearing aids do not include a "tele" coil, thus preventing their use in a classroom system.

SUMMARY OF THE INVENTION

An object of the present invention is to provide a hearing aid system which does not require removal of the user's personal hearing aid, and wherein portions of the system are acoustically coupled to the microphone input of the user's personal hearing aid so as to permit simultaneous application of local sound and remotely produced sound to the microphone input.

An object of the present invention is to provide a system for communicating with a hard-of-hearing person, the system including a radio link from a remote speaker to a receiver at the person, and a transducer responsive to the receiver for reproducing sound voiced by the speaker, and being characterized by the provision of a hollow sound conduit having an elongated wire therein for applying the audible output of the transducer to the microphone input of the personal hearing aid of the person.

A further object of the invention is to provide a hearing aid system comprising a personal hearing aid having a microphone responsive to audible sounds for producing first electrical signals, an amplifier for amplifying said electrical signals, and a first transducer for converting the first electrical signals to audible signals; a second transducer for generating sound signals in response to second electrical signals; and a hollow acoustic conduit extending between the second transducer and the microphone for conducting the sound signals from the second transducer to the microphone so that the microphone simultaneously receives both local sound and sound signals generated in response to the second electrical signals.

A further object of the invention is to provide a hearing aid system for use with the personal hearing aid, of the microphone input type, of a student in a classroom, to enable communication between a teacher and the student, the system including a microphone into which the teacher talks and a radio link, including a transmitter responsive to the teacher's microphone and a receiver for producing electrical signals representing sounds picked up by the teacher's microphone, the system being characterized by a transducer for converting the electrical signals to audible sound, and a hollow conduit for conducting the audible sound to the microphone of the personal hearing aid. The receiver may be attached to the body of the user or may be worn in the pocket. The receiver is detachably connected by electrical leads to the transducer which is contained in a housing that is removably attached by a two-sided adhesive film to the housing of the personal hearing aid. A small hollow plastic tube conducts the sound output from the transducer to the microphone input of the personal hearing aid. The hollow conduit may be wrapped around the acoustic output tube of the personal aid to provide additional structural strength.

A further object of the invention is to provide a hearing aid system as described above wherein an elongated wire is provided in the hollow conduit to provide both acoustic damping and additional structural strength.

Another object of the invention is to provide a method of communicating with a hard-of-hearing person in an environment wherein the ambient sound level at the person is higher than the level of speech voiced by a remote speaker, said method comprising: providing the person with a hearing aid with a microphone input for picking up voice sounds of higher level than the ambient sound level; providing the remote speaker with a microphone and transmitter whereby the speech voiced by the remote speaker is transmitted by wireless as a modulated carrier wave; providing the student with a receiver and transducer for receiving and detecting said modulated carrier wave and reproducing the speech voiced by the remote speaker; and applying the audible signals comprising the reproduced speech to the microphone input of the hearing aid simultaneously with, and without modification of, the ambient sound.

A further object of the invention is to provide a method of communicating as described above wherein the audible signals comprising the reproduced speech are applied to the microphone input of the hearing aid through a hollow conduit.

Other objects of the invention and its mode of operation will become apparent upon consideration of the following description and the accompanying drawings.

DETAILED DESCRIPTION OF THE INVENTION

Figure 1:
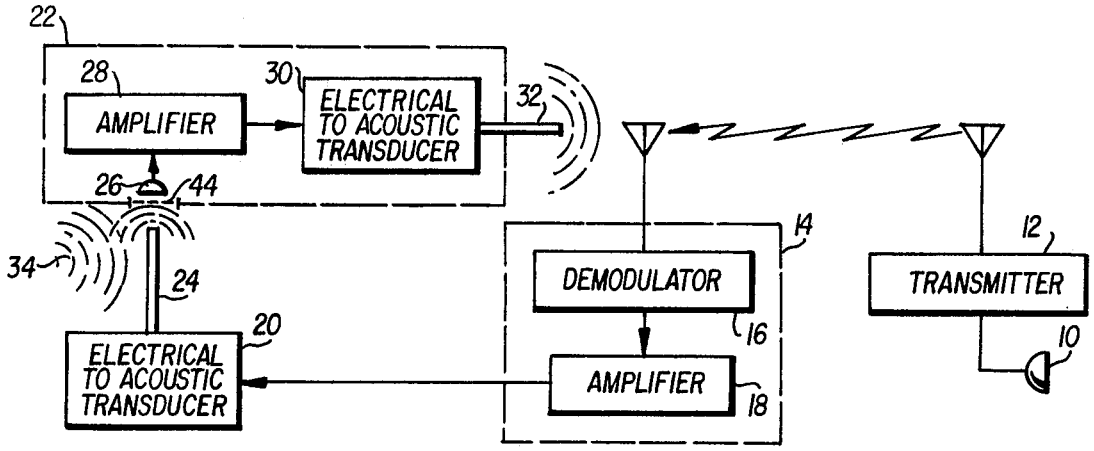
FIG. 1 is a schematic block diagram of a hearing aid system constructed in accordance with the principles of the present invention.

FIG. 1 illustrates a hearing aid system constructed in accordance with the principles of the present invention and admirably suited for use for teacher-student communication in a classroom environment. The teacher is provided with a microphone 10 into which she speaks. The output of microphone 10 is applied to a transmitter 12 which produces a modulated carrier wave that is transmitted to a receiver 14. Transmitter 12 may be of any well known type but is preferably an FM transmitter operating in the range of 72–76 mHz. The receiver 14 may be any type of receiver, preferably battery powered, compatible with the transmitter 12 and, generally speaking, includes a detector-demodulator means 16 and an amplifier means 18. Any conventional volume control means may be provided for manually adjusting the magnitude of the output signal from amplifier 18.

The output of amplifier 18 is applied to an electrical-to-acoustic transducer 20 which reproduces at its output the speech input to microphone 10. The output of transducer 20 is acoustically coupled to a personal hearing aid 22 by a hollow tube or conduit means 24.

The hearing aid 22 may be of conventional design and includes a microphone input 26 which produces electrical signals that are amplified by an amplifier 28 before being applied to an electrical-to-acoustical transducer 30. The acoustic output of transducer 30 is conducted by a hollow plastic tube 32 and a further flexible hollow tube (not shown) to the auditory system of the hearing aid user.

One end of tube 24 terminates at an opening adjacent the microphone 26 of the hearing aid. The hearing aid microphone 26 also picks up simultaneously the sound, generally indicated at 34, from the region immediately surrounding the student. From FIG. 1, it is obvious that by manually adjusting the output of amplifier 18, the output of transducer 20 may be adjusted to any level desired, including a level substantially equal to the sound emanating from the source 34. Thus, the student hears the teacher's voice at the same level as his own voice or that of other students in his vicinity, and can hear all of their voices concurrently.

Figure 2:
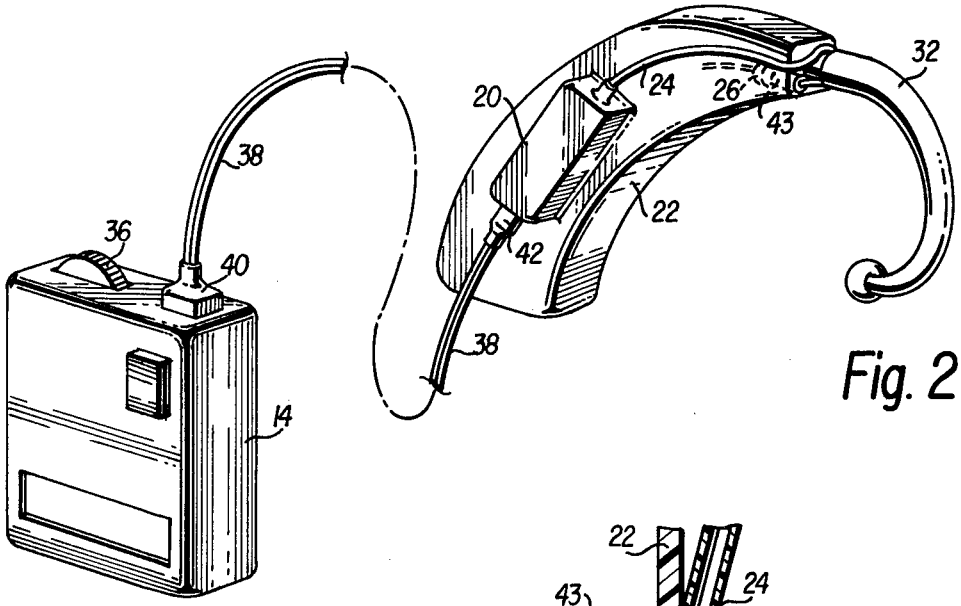
FIG. 2 is a pictorial view illustrating structural features of the receiver, transducer and a personal hearing aid.

FIG. 2 illustrates one structural arrangement of the elements of the system provided for each student. The receiver 14 is provided with its own housing and normally will be sufficiently small that it may be carried on the student's belt or else carried in a pocket. The receiver is provided with a volume control knob 36 for adjusting the output of amplifier 18. Two leads 38 are provided for carrying the electrical output signals of amplifier 18 from the receiver 14 to the transducer 20. Preferably, leads 38 are provided with a connector plug 40 at one end for plugging into the receiver and a connector plug 42 at the other end for plugging into the transducer 20. Although in some circumstances it may be desirable to carry receiver 14 with the user, it may in some instances, be desirable to leave the receiver at a fixed location. In this case the user merely disconnects connector 42 from transducer 20 and wears only his transducer 20 and hearing aid 22 when leaving the classroom.

The transducer 20 is removably attached to the housing of the personal hearing aid 22 by means of a die cut two-sided adhesive. This permits the student to easily attach or remove transducer 20 from his personal hearing aid.

As previously stated, the conduit or tube 24 conducts the acoustic output of transducer 20 to the microphone input 26 of the personal hearing aid 22. The particular hearing aid illustrated in FIG. 2 has the microphone input opening in the right side wall of the housing immediately below the region where the rigid acoustic output tube 32 is swivelly or rotatably attached to the housing of the hearing aid. With this arrangement it is convenient to wrap the conduit 24 around the tube 32 in order to obtain mechanical strength. The conduit 24 terminates at an opening immediately adjacent the microphone input opening 43 of the aid 22. As illustrated in exaggerated dimensions in FIG. 3, the conduit 24 may have its end cut at an angle so that it rests against a screen 44 covering the microphone input opening 43.

The hollow acoustic conduit 24 is preferably made of polyvinylchloride. The conduit 24 is formed by inserting a small flexible copper wire through the opening extending through the conduit, bending the assembly to the desired shape, and then heating the assembly with relatively low heat to soften the PVC. After heating, the assembly is allowed to cool. The copper wire may now be removed and the conduit 24 will retain its shape. After the conduit 24 is thus shaped, it is attached to transducer 20 by any suitable means such as, for example, an adhesive. Preferably, the end of the conduit 24 which is adjacent to the microphone input opening 43 in the hearing aid housing is left free so that the conduit 24 as well as the transducer 20 may be easily removed from the hearing aid 22.

Figure 3:
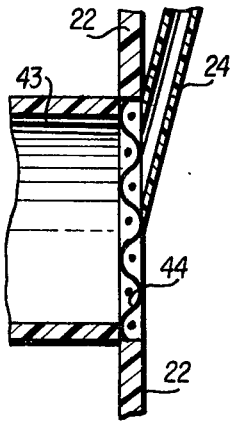
FIG. 3 is a cross-sectional view illustrating the placement of one end of a hollow sound conduit against the microphone input opening in the housing of a personal hearing aid.

The particular arrangement shown in FIG. 2 is for purposes of illustration only. For other types of hearing aids the microphone input may be located in other positions thus necessitating a different form for the conduit 24. For those hearing aids of the type wherein both the microphone input and the acoustic output openings of the hearing aid housing are covered by the end of acoustic tube 32, an opening is provided in the tube 32 through which sound may reach the microphone during normal use of the hearing aid. With a hearing aid of this type, the conduit 24 may be wrapped around the tube 32 and terminated at an opening adjacent the opening provided in the tube 32. Again, the end of the tube 24 may be cut at an angle as illustrated in FIG. 3.

For some types of hearing aids where the microphone input is close to a region where transducer 20 may be mounted, it is possible to acoustically couple the transducer and microphone without requiring a conduit 24, but a hollow conduit is preferred.

While the acoustic length and diameter of the conduit 24 may vary, it will be readily understood that these dimensions do have an effect on the quality of sound made available to microphone 26 from the conduit. Thus, these dimensions must be selected in accordance with known principles in order to obtain the best quality sound output. In a typical example, the conduit 24 is made of polyvinylchloride tubing having a length of one and ¾ inches with an internal bore of 0.030 inches and a wall thickness of 0.020 inches. While these particular properties and dimensional configurations result in a system having a frequency response through the radio link and acoustic transducer which is essentially identical to that of the hearing aid alone, it will be obvious that other materials having differing properties and dimensional configurations may be utilized.

Figure 4A:
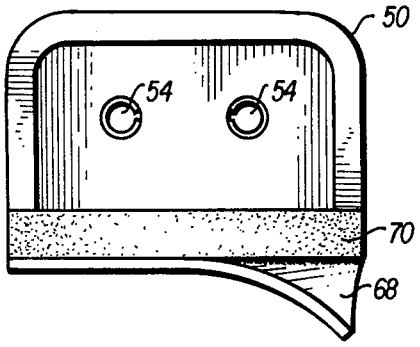
FIG. 4A is an end view of a transducer with an adhesive cover and a backing cover sheet.
Figure 4B:
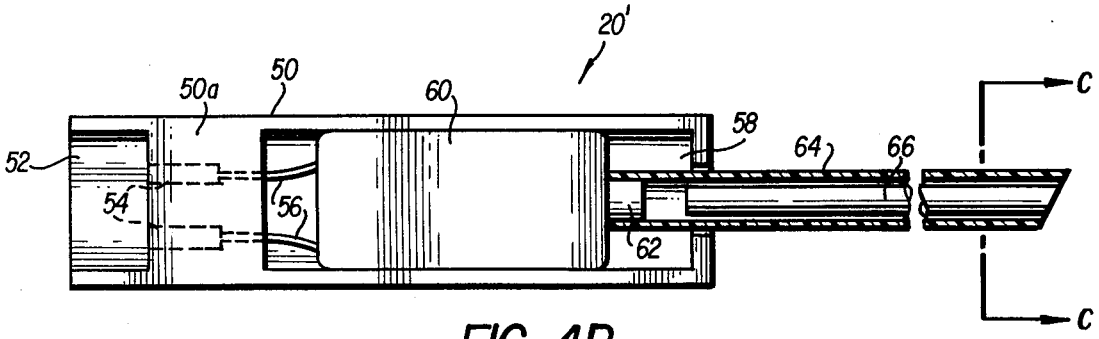
FIG. 4B is a view of a transducer with the adhesive cover and backing cover sheet removed; and, FIG. 4C is a sectional view taken along the line C—C of FIG. 4B.
Figure 4C:
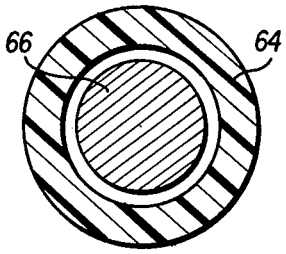

FIGS. 4A–4C illustrate a preferred embodiment wherein an electrical-to-acoustical transducer 20' is adapted to be acoustically coupled to the microphone input 26 (FIG. 1) of a hearing aid by means of a hollow acoustic conduit 64 having an acoustic loading means 66 therein. The acoustic loading means is illustrated as a rigid or semi-rigid wire damper but acoustic loading might be accomplished by using, for example, a sintered material, porous foam or fiber. The rigid wire is preferred because, even though the acoustic conduit 64 may be made of polyvinylchloride, it is not necessary to heat it in order to preshape it. The conduit 64 and wire 66 may be shaped or formed without preheating, as required in the previously-described embodiment. Once shaped, the rigidity of the wire causes the conduit 64 to retain its shape. In a practical embodiment, the acoustic conduit may have an internal bore of 0.051 inches and an outside diameter of 0.078 inches with the wire 66 having a diameter of approximately 0.037 inch.

As shown in FIGS. 4A and 4B, the electrical-to-acoustic transducer 20' includes a U-shaped plastic housing 50 with an integrally formed bridge **50*a* extending between interior faces of the legs of the channel. FIG. 4B is a bottom view of FIG. 4A, rotated 90° and with an adhesive layer 70 and a backing cover layer 68 removed. The bridge 50*a* divides the channel into two chambers 52 and 58 both normally closed on one side by layer 70. The chamber 52 is open at one end for receiving an electrical connecting plug like the plug 42 of FIG. 2. The chamber 58 holds the miniature electrical-to-acoustic transducer circuit housing 60. Female connectors 54 are mounted in bridge 50*a* and these connectors are connected by wires 56 to the transducer circuit. The acoustic output of the transducer is through a hole in a protrusion 62. The acoustic conduit 64 is inserted over protrusion 62 and preferably glued thereto. The wire 66 is cut shorter than acoustic conduit 64 so that the conduit extends about 1/32" beyond the end of the wire nearest protrusion 62. As with the previous embodiment, the conduit 64 may be cut at an angle at the end remote from the transducer 20'**.

The transducer circuit housing 60 is substantially the depth of the U-shaped channel 50 so that housing 60 together with bridge **50*a* and the tips of the legs of the channel form an adhering surface for receiving layer 70 of adhesive material. A peelable paper backing 68 protects the adhesive layer and is removed by the wearer before the transducer is stuck onto the hearing aid 22** (FIG. 2).

From the foregoing description it is seen that the present invention provides a hearing aid system particularly suited for use by students in an auditory training classroom having a high ambient noise level such that the teacher cannot be readily heard by the student wearing his personal hearing aid alone. Components of the system are readily detachable from the personal hearing aid of the student and may be left in the classroom. Thus, when moving from one class to another the student merely disconnects the plug 42 for the unit in the room he is leaving and reconnects plug 42 of the unit in the classroom he enters. The system does not require that the user remove his personal hearing aid, an important feature since such aids are normally professionally fitted. Furthermore, the amplification of the system may be adjusted such that the sound level of the teacher's voice as reproduced at the input of the personal hearing aid may be the same or greater than the level of the user's or other student's voices at the input to the aid. Finally, the present system permits the user to simultaneously hear not only the teacher's voice but his own voice and the voices of the other students.

While the invention has been described as being particularly adapted for use in a student-teacher classroom environment, it is equally useful in other high ambient noise level environments such as conferences, construction sites, or work areas in manufacturing facilities. Furthermore, while described in conjunction with an on-the-ear type aid, the invention is equally adaptable for use with an in-the-ear type aid. Other variations, modifications and substitutions may obviously be made in the preferred embodiment described herein without departing from the spirit and scope of the invention. It is intended therefore to be limited only by the scope of the appended claims.

We claim:

1. A hearing aid system comprising:

a hearing aid including a microphone responsive to audible sounds for producing first electrical signals, means for amplifying said first electrical signals, and first transducer means for converting said first electrical signals to audible sound signals;

second transducer means for generating sound signals in response to second electrical signals;

a hollow acoustic conduit extending between said second transducer means and said microphone for conducting the sound signals from said second transducer means to said microphone;

means for applying said second electrical signals to said second transducer means;

a first housing for at least said microphone and amplifying means of said hearing aid;

a second housing for said second transducer means; and, means for mounting said second housing on said first housing with said first housing supporting said second housing.

2. A hearing aid system as claimed in claim 1 wherein the means for mounting said second housing on said first housing comprises a two-sided adhesive film whereby said second housing is removably attached to said first housing.

3. A hearing aid system as claimed in claim 1 further including means for producing said second electrical signals, said latter means comprising:

a receiver for receiving a transmitted carrier wave modulated with audio information, said receiver including means for detecting said audio information and generating said second electrical signals.

4. A hearing aid system comprising:

a hearing aid including a microphone responsive to audible sounds for producing first electrical signals, means for amplifying said first electrical signals, and first transducer means for converting said first electrical signals to audible sound signals;

second transducer means for generating sound signals in response to second electrical signals;

a hollow acoustic conduit extending between said second transducer means and said microphone for conducting the sound signals from said second transducer means to said microphone;

means for applying said second electrical signals to said second transducer means;

first and second housings for said hearing aid and said second transducer means, respectively; and, an audio output tube extending from the first housing;

said hollow acoustic conduit extending around said audio output tube to mechanically help support said second housing and said hollow acoustic conduit on said first housing.

5. A method of communicating with a hard-of-hearing person in an environment wherein the ambient sound level at the person is higher than the level of speech voiced by a remote speaker, said method comprising:

providing the person with a hearing aid with a microphone input for picking up said ambient sound;

providing the remote speaker with a microphone and transmitter whereby the speech voiced by said remote speaker is transmitted by wireless as a modulated carrier wave;

providing the person with a receiver and transducer for receiving and detecting said modulating carrier wave and reproducing the speech voiced by said remote speaker as audible signals; and conducting the audible signals comprising said reproduced speech through a hollow conduit from said transducer to the microphone input of said hearing aid while simultaneously permitting said ambient sound to enter said microphone unobstructed.

6. A method as claimed in claim 5 and further including the step of amplifying said detected modulated carrier wave whereby the level of said reproduced speed applied to said microphone input is approximately the same as that of said ambient sound.

7. A hearing aid system comprising:

a hearing aid including a microphone responsive to audible sounds in the environment surrounding the wearer for producing first electrical signals, means for amplifying said first electrical signals, and first transducer means for converting said first electrical signals to audible sound signals;

second transducer means for generating sound signals in response to second electrical signals; and, a hollow acoustic conduit for conducting the sound signals from said second transducer means to a region in the vicinity of said microphone for application of said sound signals to said microphone concurrently with said audible sounds, without noticeably affecting the intensity of said audible sounds.

8. A hearing aid system as claimed in claim 7 wherein said hearing aid is provided with a first housing and said second transducer means is provided with a second housing; and said hearing aid system further includes means supporting said second housing on said first housing.

9. A heating aid system as claimed in claim 8 and further comprising acoustic damping means in said hollow acoustic conduit.

10. A hearing aid system as claimed in claim 7 and further comprising an elongated wire inside said hollow acoustic conduit, said wire providing acoustic damping.

11. A hearing aid system as claimed in claim 10 wherein said hollow acoustic conduit is flexible and said wire has sufficient rigidity to hold said acoustic conduit in a desired configuration.

12. A hearing aid system as claimed in claim 11 wherein said hollow acoustic conduit is attached at one end to said second transducer means, and the other end is supported by said wire near said microphone.

13. A hearing aid system as claimed in claim 7 in combination with a portable means for applying said second electrical signals to said second transducer means, said portable means to be worn by said user.

14. The combination as claimed in claim 13 wherein said means for applying said second electrical signals to said second transducer means comprises:

a receiver for receiving a transmitted carrier wave modulated with audio information, said receiver including means for detecting said audio information and generating said second electrical signals, said receiver being battery powered whereby it may also be worn by said user as he moves from one location to another.

15. The combination as claimed in claim 14 and further comprising a separable electrical connector for connecting said receiver to said second transducer means, whereby said receiver may be left at one location when said hearing aid system user leaves said one location.

16. A system for aiding a hard-of-hearing student in a classroom, said student wearing a personal hearing aid including a student microphone for picking up sounds in the environment surrounding the student and producing first electrical signals therefrom, means for amplifying said first electrical signals, and first transducer means for converting said first electrical signals to audible sound signals, said system including:

a teacher microphone and transmitter for the wireless transmission of signals representing the teacher's voice;

a receiver associated with the student, said receiver including a volume control means for controlling the magnitude of electrical output signals produced by said receiver;

a second transducer means responsive to the electrical output signals from the receiver for producing audible signals representing the teacher's voice;

an elongated hollow conduit for conveying said audible signals to a region near said student microphone for application to said student microphone simultaneously with said sounds from the environment whereby said student may simultaneously hear both said teacher's voice, at a sound level controlled by said volume control means, and said sounds from said environment.

17. A system as in claim 16 and including a separable electrical connector means connected between said receiver and said second transducer means whereby said second transducer means may be disconnected from said receiver and carried with said hearing aid when the student leaves the classroom.

18. A system as claimed in claim 16 wherein said hollow conduit has an elongated wire disposed therein for acoustic damping and to provide rigidity for said hollow conduit.

* * * * *

UNITED STATES PATENT AND TRADEMARK OFFICE

CERTIFICATE OF CORRECTION

PATENT NO. : 4,259,547

DATED : March 31, 1981

INVENTOR(S) : Robert S. Valley; David S. MacDonald

It is certified that error appears in the above—identified patent and that said Letters Patent is hereby corrected as shown below:

Col. 6, line 35, change "student's" to --students'--.
Col. 7, line 51, change "modulating" to --modulated--;
line 53, insert a comma after "and"; and
line 61, change "speed" to --speech--.
Col. 8, line 18, change "heating" to --hearing--.

Signed and Sealed this

*Thirtieth* Day of *June 1981*

[SEAL]

*Attest:*

RENE D. TEGTMEYER

*Attesting Officer*

*Acting Commissioner of Patents and Trademarks*